US006062978A

United States Patent [19]

Martino et al.

[11] Patent Number: 6,062,978

[45] **Date of Patent: *May 16, 2000**

[54] ROTATING CUBE COMPUTER VIDEO GAMES

[75] Inventors: Peter D. Martino, Phoenixville; Gerald Beirne, Newtown Square, both of Pa.

[73] Assignee: Four Star Software, Inc., Wayne, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/570,287

[22] Filed: Dec. 11, 1995

[51] Int. Cl.[7] ..... A63F 9/24

[52] U.S. Cl. ..... 463/9; 463/32; 273/153 R

[58] Field of Search ..... 463/31–33, 9; 273/272, 153 R; 395/119, 123, 137

[56] References Cited

U.S. PATENT DOCUMENTS

| | | | |
|---|---|---|---|
| 2,886,325 | 5/1959 | Long | 273/272 |
| 3,930,651 | 1/1976 | Rader | 273/272 |
| 4,437,667 | 3/1984 | Miller | 273/272 |
| 4,575,087 | 3/1986 | Sinclair | 273/153 R |
| 4,809,979 | 3/1989 | Skowronski et al. | 273/153 R |
| 4,863,172 | 9/1989 | Rosenwinkel et al. | 273/153 S |
| 4,957,291 | 9/1990 | Miffitt et al. | 273/153 R |
| 5,303,388 | 4/1994 | Kreitman et al. | 395/137 |
| 5,312,113 | 5/1994 | Ta-Hsien et al. | 273/434 |
| 5,379,057 | 1/1995 | Clough et al. | 345/173 |
| 5,485,197 | 1/1996 | Hoarty | 395/137 |
| 5,515,486 | 5/1996 | Amro et al. | 395/119 |
| 5,667,438 | 9/1997 | Rehm | 463/9 |
| 5,803,461 | 9/1998 | Pavlovic | 273/153 R |

*Primary Examiner*—Valencia Martin-Wallace
*Attorney, Agent, or Firm*—Woodcock Washburn Kurtz Mackiewicz & Norris LLP

[57] ABSTRACT

A rotating cube game or puzzle which is displayed on a computer display screen in three dimensions and is manipulated in three dimensions to expose the respective faces during play of the game or solving of the puzzle. The game or puzzle is preferably implemented on the cube in such a manner that there is continuity among the respective edges. For example, individual crossword puzzle entries are designed to wrap around the edges as desired. The letters for the sides of the cube facing the user are drawn by reading the letters stored in the appropriate three of six total two-dimensional arrays (one array for each face of the cube), and the arrays are manipulated as the cube rotates so that the right and top sides of the cube facing the user will be displayed correctly. Entries in the arrays may be spun 90 or 180 degrees, as appropriate, and then drawn in each block at the correct perspective angle. The cube is rotated by selecting arrows on an on-screen icon, and the letters are entered by the user by selecting the block and then entering the desired letter using the keyboard or selecting, using a mouse, a letter from a keyboard displayed on the video display. The desired letter is entered into the appropriate array for that side and displayed. If a letter is entered in a block shared with another side, the letter is copied into the appropriate array entry for the other side as well. Other games such as Reversi®, Othello®, and Scrabble™ may be played in three dimensions using the techniques of the invention.

26 Claims, 6 Drawing Sheets

6
CrosswordCUBE - PUZ02.PUZ
File Options Help
10
16
14
20
22
18
12
Across
1 Catastrophe
7 Boom, bang
8 Nostrils
10 Personifies, represents
11 --shade
12 Tiny state (abbr.)
13 Test for college
14 Love
16 Late martial arts star
17 Penny
18 Retrieves
Down
1 Lion's
2 Plan of action
3 Noise for "Excuse me"
4 Alledged criminals
5 Abrev for 6 pts in football
6 Withstand
9 Peter
10 Blood needs this
13 Hole, silver
15 Sleep

ROTATING CUBE COMPUTER VIDEO GAMES

BACKGROUND OF THE INVENTION

1. Field of the Invention

The present invention relates to computer video games, and more particularly, to computer video games implemented on a rotating cube.

2. Description of the Prior Art

Computer video games have become popular entertainment options for children and adults alike. Many fantasy games have been created and many traditional games such as chess, draw poker and the like have been implemented in a computer video format. However, such video games typically keep the same format as the original game and, although often displayed in three dimensions, are generally limited to two-dimensional play on the video screen. In other words, traditional video games generally do not permit the game to be manipulated and played in three dimensions and thus do not permit the additional level of complexity possible when the games are played in three dimensions.

Three-dimensional cube manipulating puzzles such as RUBIK'S CUBE® have been around for some time and have even been implemented in video form. For example, Ta-Hsien et al. describe in U.S. Pat. No. 5,312,113 a video puzzle cube game in which all six sides of the cube are displayed at a time. Menu options are provided which permit manipulation of the cube for matching patterns in a manner akin to solving a RUBIK'S CUBE® puzzle. Scoring of the game is directly proportional to the number of identical unit squares on the same side of the cube. Scoring is maximized by solving the puzzle rapidly. However, no mention is made of extending this cube game concept to other types of games, particularly word games such as crossword puzzles.

Crossword puzzles and other word games have become increasingly popular. Crossword puzzles and word games are found in most daily newspapers as well as in crossword puzzle and word game books. Unfortunately, because of the paper medium on which the crossword puzzles and word games are presented, the crossword puzzles and word games have been limited to two dimensions. Of course, if the presentation could be extended to a third dimension, the puzzles and word games could be made much more challenging.

The present inventors propose to use the computer video medium for presenting crossword puzzles and other games so that the puzzles and games may be solved (played) in three dimensions on a laptop computer, home computer, or the like. As will be described below, such games and puzzles are not limited to simple manipulating and matching games of the type disclosed by Ta-Hsien et al.

SUMMARY OF THE INVENTION

The present invention relates to traditional games implemented on a rotating cube displayed on a computer display screen in three dimensions. The rotating cube permits the game to be played and manipulated in three dimensions by allowing the player to manipulate the cube to expose the respective faces during play of the game or solving of the puzzle.

The game or puzzle is preferably implemented on the cube in such a manner that there is continuity among the respective edges. For example, a crossword cube puzzle is preferably implemented such that it has edges which are shared by contiguous sides. Individual crossword puzzle entries may also be designed to wrap around the edges as desired. Reversible words may be used along some edges to maintain continuity. The cube is manipulated during play so that the respective sides may be viewed as needed.

Rotation of the cube is preferably accomplished by probing an on-screen spinner using a mouse or by making appropriate keyboard selections. The cube is rotated on the video display by dividing the distance from where the eight vertices defining the cube are before rotation to the place the vertices occupy after rotation of the cube by the number of iterations the cube will spin. During rotation, these values are added to the starting vertices for each iteration until the final position is reached. By increasing the number of iterations, smooth rotation is accomplished. After each rotation, the sides facing the user are drawn and colored and the other sides are erased from the video display. The contents of each face of the cube, the spinner, and a menu are also drawn on the display screen.

In order to make the rotation of the cube look more realistic, a variable is added to the x and y coordinates during rotation which is related to the distance of a given point from the center of the cube. This variable has a larger value during the middle of the spin and gives the cube a rounder motion so that the cube does not appear to shrink as it spins.

In the crossword puzzle example, the letters for the sides of the cube facing the user are drawn by reading the letters stored in the appropriate three of six total two-dimensional arrays (one array for each face of the cube). The clue numbers for the facing side are also pulled from a clue array and presented on the video display. The arrays are manipulated as the cube rotates so that the right and top sides of the cube facing the user will be displayed correctly. In particular, entries in the arrays are spun 90 or 180 degrees, as appropriate, and then drawn in each block at the correct perspective angle.

Letters are entered by the user with a mouse by selecting the block and then entering the desired letter using the keyboard or selecting, using a mouse, a letter from a keyboard displayed on the video display. The entered letter is entered into the appropriate array for that side and displayed. If a letter is entered in a block shared with another side, the letter is copied into the appropriate array entry for the other side as well. This is the case where the crossword puzzle wraps around edges. This feature may necessitate that some words along edges of the cube be reversible.

The present invention is preferably implemented in software and distributed to users via a computer readable medium such as a floppy disk, an optical disk, a CD ROM or otherwise transmitted to a host computer in digital form. Play of the game is then controlled by the microprocessor of the host computer.

Other games, such as Reversi®, Othello®, and Scrabble™ may be played in three dimensions using the techniques of the invention.

BRIEF DESCRIPTION OF THE DRAWINGS

The above-mentioned characteristic features of the invention will become more apparent to those skilled in the art in view of the following detailed description of the invention, of which.

DETAILED DESCRIPTION OF THE PRESENTLY PREFERRED EMBODIMENT

A system and method which meets the above-mentioned objects and provides other beneficial features in accordance with the presently preferred exemplary embodiment of the invention will be described below with reference to FIGS. 1–6. Those skilled in the art will readily appreciate that the description given herein with respect to those figures is for explanatory purposes only and is not intended in any way to limit the scope of the invention. For example, while the preferred embodiment of the invention is described with respect to a crossword cube game, those skilled in the art will appreciate that numerous other games such as Reversi® (FIG. 5), Scrabble™ (FIG. 6), Othello®, checkers, chess, and the like may be implemented in three dimensions on a computer video screen in accordance with the techniques of the invention. Accordingly, all questions regarding the scope of the invention should be resolved by referring to the claims.

Figure 1:
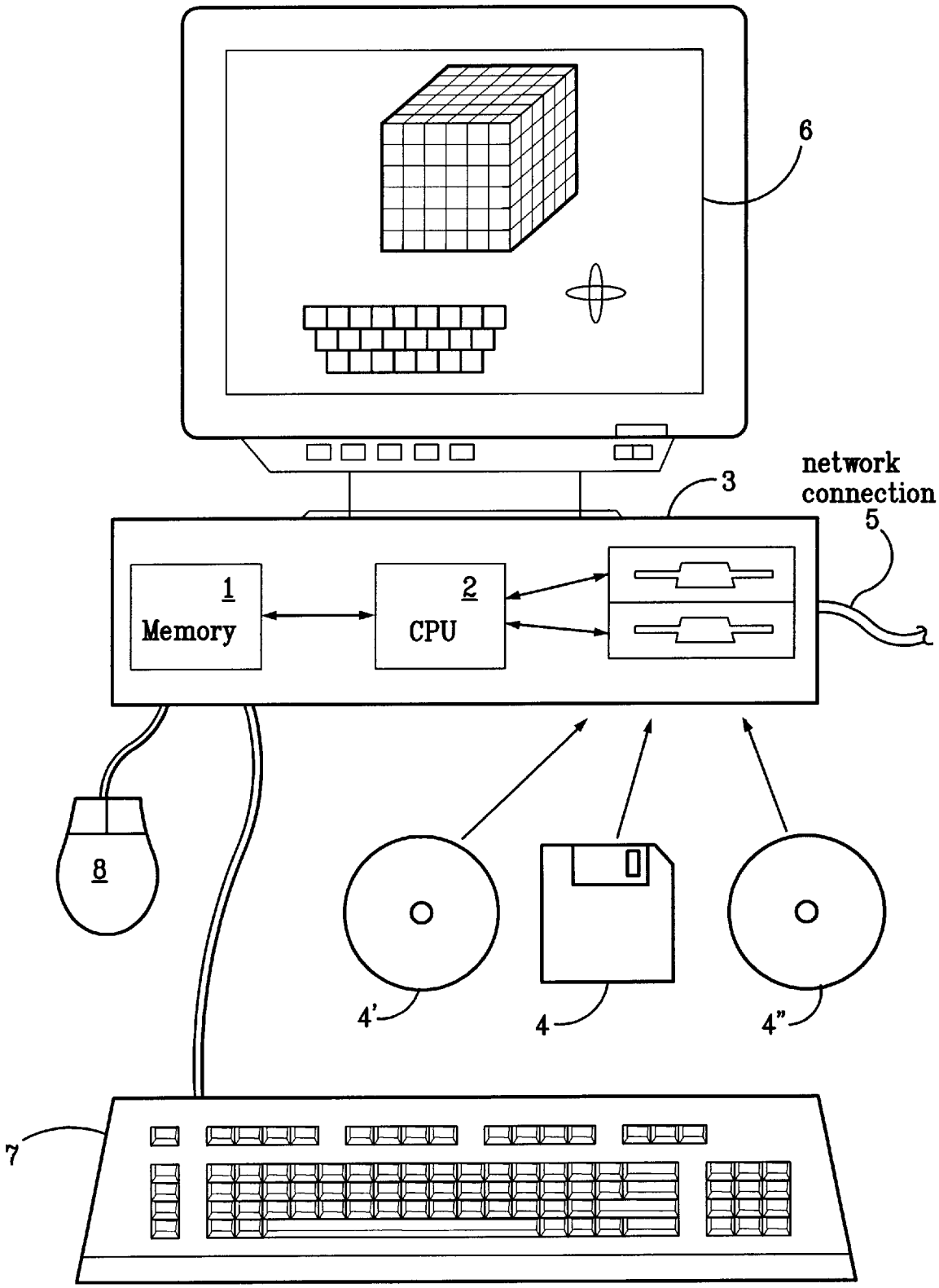
FIG. 1 illustrates a host computer which accepts a computer readable medium, such as a floppy disk, an optical disk, or a CD ROM, and may be connected to a computer network to receive data including game software in accordance with the invention.

The present invention is preferably implemented as software containing instructions for controlling a processor, which in turn controls the display on a computer. FIG. 1 illustrates such a computer. In a preferred embodiment, software implementing the invention is stored on a program storage device 1 readable by a processor 2 of computer 3 whereby the program of instructions stored thereon is executable by the processor 2 to perform the method steps of the invention. As shown in FIG. 1, the game software is provided in digital form on a computer readable medium such as a floppy disk 4, an optical disk 4', or a CD ROM 4", or is otherwise transmitted to the host computer 3 in digital form over a network connection 5 and loaded into the computer's memory 1. During play of the game software loaded on the memory 1 of the host computer 3, the game's graphics images are displayed on a computer video display 6, and play of the game is controlled by user entries via keyboard 7 and mouse 8.

Figure 2:
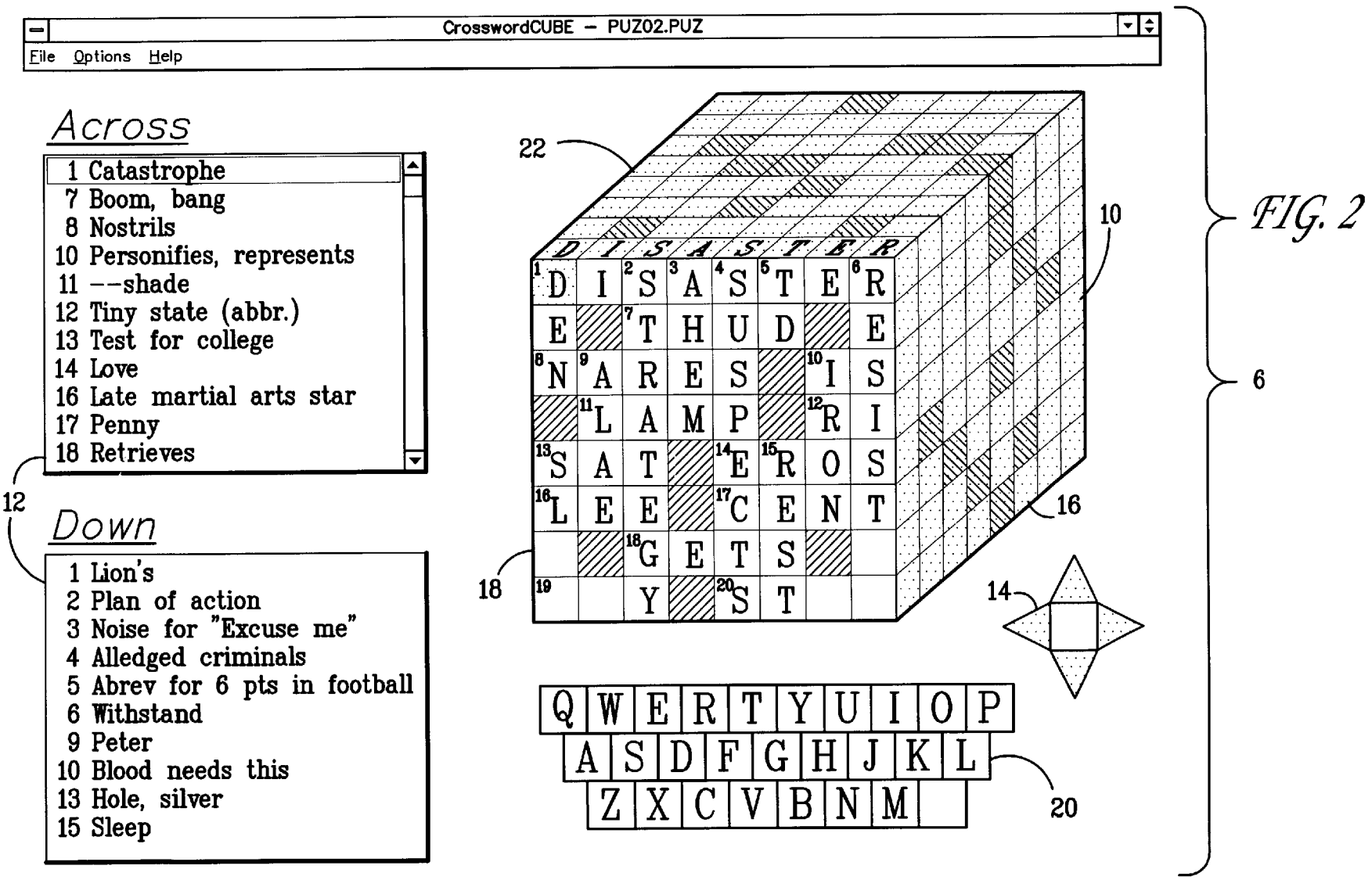
FIG. 2 illustrates a crossword cube game as displayed on a video display screen in accordance with the invention.

FIG. 2 illustrates a crossword cube game as displayed on a video display screen in accordance with a preferred embodiment of the invention. As illustrated, the crossword puzzle is implemented on a game cube 10 of the computer's video display 6. The clues for the side of game cube 10 facing the user are displayed in a menu area 12 as shown. In a preferred Windows® implementation of the invention, the game cube 10 is rotated and manipulated by using a mouse 8 (FIG. 1) to select one of the spinner arrows of spinner 14. For example, if the user selects the left spinner arrow of spinner 14, the right face 16 of game cube 10 will rotate around to replace the front face 18. Letters may be entered into the game cube 10 by selecting the appropriate box with the mouse 8 and typing in the appropriate letter using the keyboard 7. Alternatively, the letter may be entered into the selected box by selecting the desired letter from a software keyboard 20 displayed on the display screen using the mouse 8. As another alternative, the user may select "across" or "down" and then type in the letters in sequence before pressing "enter" or again pressing the select button of the mouse 8. Such alternatives are left to the preference of those skilled in the art.

Spinner object 14 is the icon used to start the game and also to spin the game cube 10 using the mouse 8. The colors on spinner 14 preferably change each time the game cube 10 spins. In other words, the color of the square in the center of spinner 14 is preferably the color of the side 18 of the game cube 10 facing the user, and the top arrow of spinner 14 is the color of the top side 22 of the game cube 10, etc. If the user wants to work on the top side 22, the user would probe the top of the spinner 14. The game cube 10 would then spin down, with the color of the square in the spinner object 14 changing to the color of the side now facing the user. The colors of the other arrows of spinner 14 would be adjusted accordingly.

Figure 3:
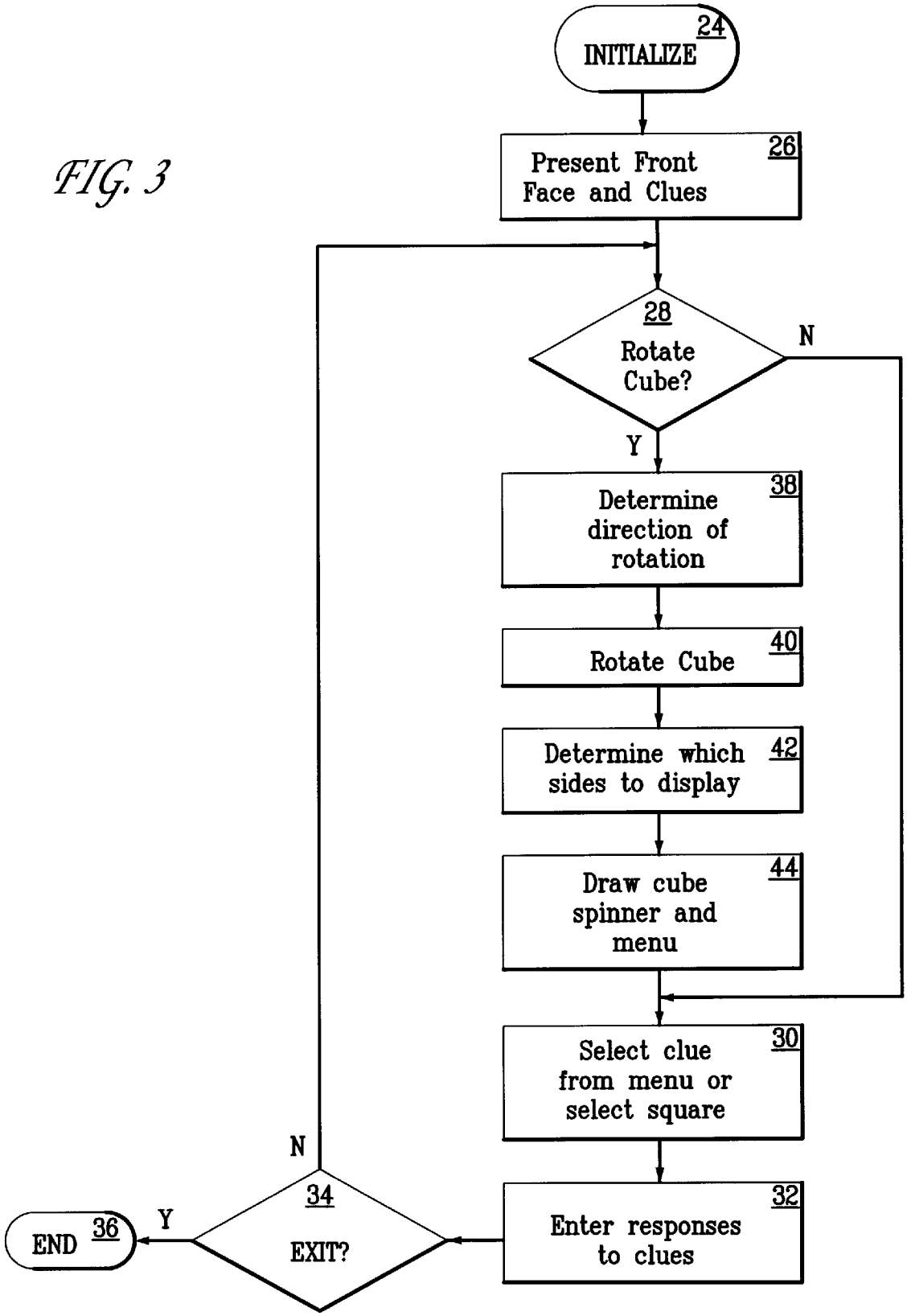
FIG. 3 illustrates a flow chart of the play of a crossword cube game in accordance with a preferred embodiment of the invention.

As illustrated in FIG. 3, play of a three dimensional crossword game on game cube 10 is initiated at step 24 by presenting a new crossword puzzle on the game cube 10 upon selection of the crossword game option. A default (front) face of the game cube 10 and associated clues are presented to the user at step 26. Question 1 across is initially the active question, and the associated square or squares in the game cube 10 is highlighted by a bright color. At step 28, the user determines whether he or she wishes to rotate the game cube 10 to another face. If not, the user begins play by selecting the clue from menu 12 or by selecting squares for completion at step 30. The user then enters the appropriate responses to the clues at step 32. It is then determined at step 34 whether the user wishes to exit. If so, play of the game ends at step 36. Otherwise, control return to step 28.

If it is determined at step 28 that it is desired to rotate the game cube 10 to another face, the game cube 10 is rotated to display another face. The direction of rotation of the game cube 10 is determined at step 38 by probing the desired spinner arrow of spinner 14 with mouse 8. In the absence of a mouse 8, the user may enter <Alt-D> for rotate down, <Alt-U> for rotate up, <Alt-L> for rotate left, or <Alt-R> for rotate right using keyboard 7. Once the user decides which way to spin the game cube 10, the software rotates the game cube 10 at step 40 in the manner described in more detail below. As will be noted below, the text for the respective sides is rotated as necessary so that it has the correct orientation with respect to the user. It is then determined at step 42 which side(s) of the game cube 10 will be facing the user so that the appropriate side(s) and colors will be displayed in the correct orientation. Then, at step 44, the proper sides and colors of the game cube 10 are drawn, as well as the menu 12, the spinner 14, and the optional keyboard 20. Once the desired side and square is selected at step 30, the corresponding across question may be selected by probing the left button of the mouse 8, while the corresponding down question may be selected by probing the right button of the mouse 8. On the other hand, the user may probe the questions directly from the menu 12 at step 30, and the corresponding square(s) on the game cube 10 will light up and each letter entered for that clue may optionally blink. As before, the user then enters the responses to clues at step 32 using the mouse 8 and/or keyboard 7.

In a preferred embodiment, information for each side of the game cube 10 is kept in a different array in the memory of a computer storage device. For example, each array may contain the colors and crossword pattern for the associated side as well as entry positions for the respective characters. Preferably, the clues for that side are also stored in such a manner that they are correlated with the associated side for display. The arrays can be of any desired size in accordance with the puzzle size.

When the user rotates the game cube 10 at step 40 of FIG. 3, the display for one side of the cube is gradually replaced by the display for the selected side of the cube. The rotating motion is simulated by creating a series of frames containing the respective iterations of the game cube 10 as it rotates. The coordinates for the cube representation in each iteration are calculated by dividing the distance from where the game cube's eight vertices (represented as arrays of x points, ptx, and y points, pty) are located before rotation to where the eight vertices are located after rotation by the number of iterations the game cube 10 will spin. The result will be an array of sixteen values, an incremental X and Y value for each vertex for each iteration. These values are stored in remptx and rempty arrays, respectively, and are added to the original vertices once for each iteration in a spin_cube functions for each iteration. The game cube 10 is drawn for each iteration so that a smooth rotation appears on the display. Of course, increasing the number of iterations and/or interpolating will smooth out the rotation.

The spin_cube function then sets the vertices of the rotated cube in arrays ptx and pty to where the old vertices were. In other words, the rotation is completed back to the same display position, only for a different side, by repeatedly adding the remptx and rempty array values to ptx and pty until game cube 10 is back to its original position. If the game cube 10 must spin more than once to get to the correct orientation, the appropriate routine is called for each rotation.

After each rotation at step 40, the spin_cube function decides which sides are facing the user and draws the corresponding polygon(s) making up those sides at steps 42 and 44. As illustrated in FIG. 2, there are always exactly three sides displayed at a time. The spin_cube function also erases any images that are left behind as the game cube 10 rotates. This is done by selecting one of eight polygons which wrap around the outside of the facing polygons. A six sided polygon having the same color as the background of the game may be displayed for this purpose.

Once the game cube 10 is rotated, the lines of the game cube 10 are drawn using a draw_cube function. This function draws the same thing every time for each side except that the colors may change according to which side(s) of the game cube 10 are facing the user. Once the lines of the game cube 10, the clues 12, the spinner 14, and the optional keyboard 20 are drawn at step 44, the text is "populated" within the three faces of the game cube 10 visible to the user. The orientation of the game cube 10 on the display screen is taken into consideration when the text is drawn so that the text is properly rotated to be upright for the user. The game cube 10 is now ready for additional entries (step 30).

In order to improve the appearance of the rotation of the cube, the inventors have found it desirable to include the variables x_stretcher and y_stretcher to make the cube rotate more like a sphere. In other words, the spin is made to appear rounder, and hence more realistic. In short, the inventors have found that rotating the game cube 10 directly between two points makes the game cube 10 appear to shrink as it spins. "x_stretcher" and y_stretcher are added to or subtracted from each point in accordance with that point's orientation with respect to the center of the game cube 10 so that the rotation appears "rounder." For example, since it is desired that the values for x_stretcher and y_stretcher increase during the middle of the spin, the values for x_stretcher and y_stretcher start as negative numbers at the beginning of the spin, have values near zero at the middle of the spin, and have positive values near the end of the spin. The data is preferably structured so that the "stretcher" values will be largest when the absolute value of the loop variable is smallest.

A source code listing for a sample program for spinning and drawing the game cube 10 in Microsoft C++ follows in Appendix A.

In a preferred embodiment, the letters for the game cube 10 are stored in six two-dimensional arrays, one for each face of the game cube 10. As noted above, after the game cube 10 rotates, there are three sides visible—the front 18, right side 16, and top 22. A draw_text procedure draws the text on the front side 18, and the procedures draw_text_right and draw_text_top draw the text on the right side 16 and top side 22, respectively. The text on the front side 18 is always drawn unrotated, while the text on the right side 16 and top side 22 are drawn rotated and scaled in the proper perspective.

The clue numbers are also drawn on the front side 18 and may be optionally drawn on the right side 16 and top side 22. The data for the numbers and the location of the words on the puzzle are stored in an array datafa. For example, if the word is 10 down, the datafa array might say to put this number in the block that is seven over and three down (FIG. 2).

The source code of a draw_text procedure in Microsoft C++ in a preferred embodiment of the invention is as follows:

```
**********************************************
double CCubeView::draw_text(){
    char letter[2], string[2];
    CubeNoFont.CreateFont (
12,0,0,0,200,FALSE,FALSE,0,ANSI_CHARSET,OUT_TT_PRECIS,
CLIP_DEFAULT_PRECIS,PROOF_QUALITY,DEFAULT_PITCH|FF_SWISS,
"Arial");
    CFont* pOldFont=(CFont*)  pDC>SelectObject (&CubeNoFont);
    for (col=0;col<num_cols;col++)  {
    for (row=0;row<num_rows;row++)  {
        text_locx=(int) (conptxl-16+ (block_width* (row+1)));
        text_locy=(int) (conptyl18+ (block_height* (col+1)));
        if (facing_side == ft) letter[0]=front[col] [row];
        if (facing_side == rt) letter[0]=right[col] [row];
        if (facing_side == tp) letter[0]=top[col] [row];
        if (facing_side == bm) letter[0]=bottom[col] [row];
        if (facing_side == lt) letter[0]=left[col] [row];
```

-continued

```
            if (facing_side == bk) letter[0]=back[col] [row];
    // Any empty block is marked with a "-" which signals the
// code below to fill in the block with black
      if(front_ans[col] [row] == "-" || fillit == 0)   {
            x0=(int) (conptxl+ (block_width*row) +0);
            y0=-(int) (conptyl+ (block_height*col) +0);
            x1=(int) (conptxl+ (block_width* (row+1)));
            y1=-(int) (conptyl+ (block_height* (col+1)));
            CRgn theRgn;
            pDC->SelectObject   (&lines);
            theRgn.CreateRectRgn (x0,y0,x1,y1);
            pDC->FillRgn     ( &theRgn, 7MyBrushBlank);
      }
      else if(isalpha(letter[o]) & !game_just_started ) pDC-
>TextOut (text_locx+3, - (text_locy+3) ,letter,1);
    }
  }
  pDC->SelectObject (&CubeNoFont);
  ctr=0;
  while(datafa[ctr] [3] != NULL {
            temp_holder[0]=NULL;
            temp_holder[1]=NULL;
            temp_holder[2]=NULL;
            temp_holder[0]=datafa [ctr] [7];
            temp_holder[1]=datafa [ctr] [8];
            across=atoi (temp_holder);
              temp_holder [0]=datafa [ctr] [4];
              temp_holder[1]=datafa[ctr] [5];
              down=atoi (temp_holder);
              text_locx=(int) (conptxl+2+(block_width*across));
              text_locy=(int) (conptxl+1+(block_height*down));
              number+datafa[ctr] [1];
              if (number!=' ')   {
                string [0]=number;
                PDC->TextOut (text_locx,-text_locy,string,1);
                text_locx+=5;
              }
              number=datafa[ctr] [2];
              string [0]=number;
              pDC->TextOut(text_locx,-text_locy,string,1);
              ctr++;
            }
            ctr=0;
            while(datafd[ctr] [3] !=NULL)   {
              temp_holder[0]=datafd[ctr] [7];
              temp_holder[1]=datafd[ctr] [8];
              across=atoi (temp_holder);
              temp_holder[0]=datafd[ctr] [4];
              temp_holder[1]=datafd[ctr] [5];
              down=atoi (temp_holder);
              text_locx=(int) (conptxl+2+block_width*across));
              text_locy=(int) (conptx1+1+block_height*down));
              number=datafd[ctr] [1];
              if(number!=' ')   {
                string [0]=number;
                pDC->TextOut (text_locx,-text_locy,string,1);
                text_locx+=5;
              {
              number=datafd[ctr] [2];
              string[0]=number;
              pDC->TextOut(text_locx,-text_locy,string,1);
              ctr++;
      }
}
*************************************************
```

Figure 4:
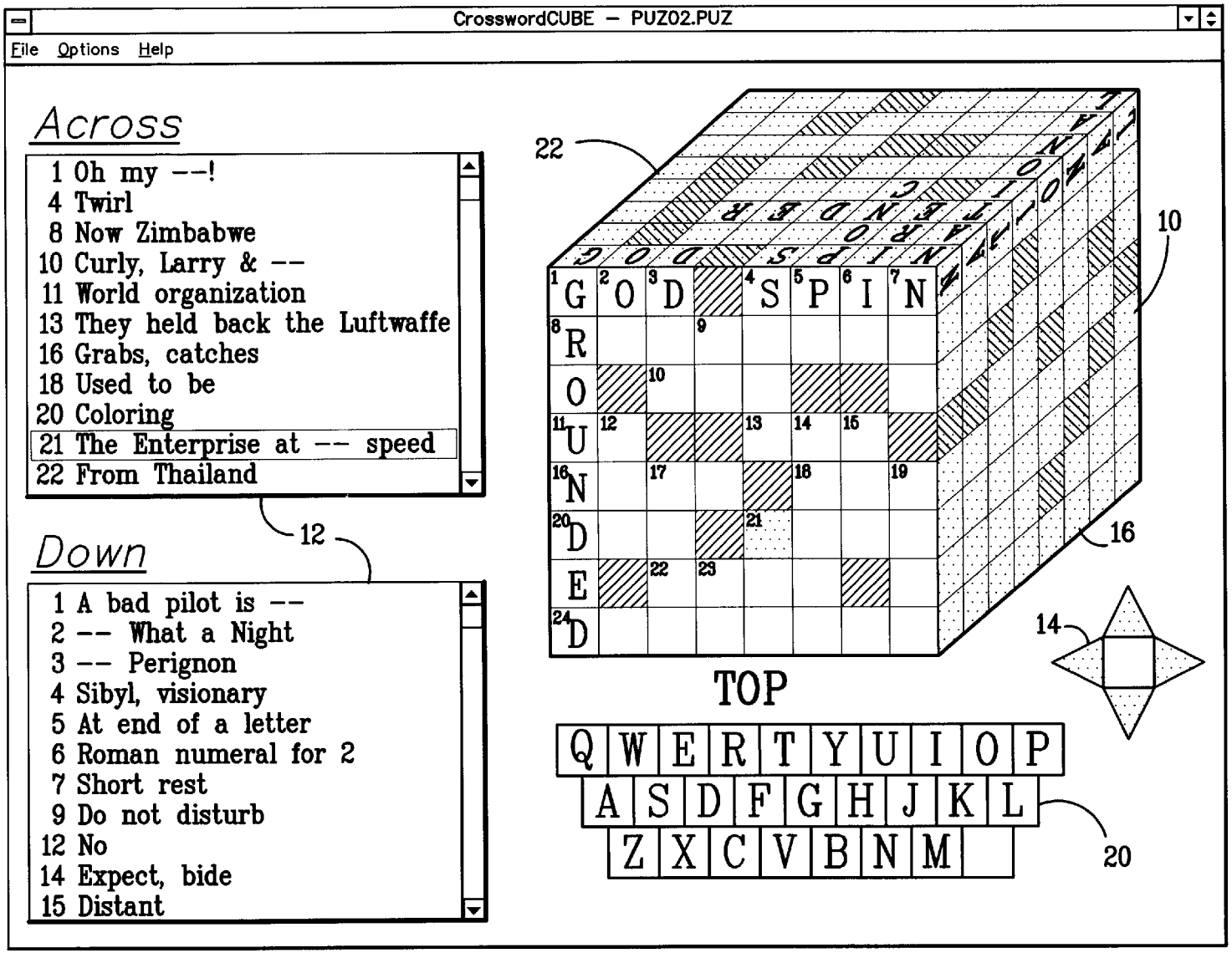
FIG. 4 illustrates a crossword game cube rotated such that two abutting sides have text facing in different directions.

Because of the perspective effect of the sides not parallel to the screen, displaying the text on the top and the right sides is a bit more complicated. The logic for the way the sides are related to each other is as follows: If the game cube 10 starts with the front face 18 and spins four times to the right or left, the cube will of course be back to where it started, and nothing unusual is seen. Also, if the game cube 10 is spun up or down, the text remains normal. However, the complexity comes in during certain situations such as when the top of the game cube 10 is facing the user and the user elects to spin the game cube 10 down. In the latter case, as shown in FIG. 4, the two abutting sides of the game cube 10 face in different directions, and the right side is going in still another direction. As a result, when the game cube 10 spins, it cannot just spin downward. To be logically correct, the game cube 10 needs to spin in a way that the back side will now face the user correctly. Also, at all times, the display must show the right and top sides correctly, which necessitates manipulating the arrays so that the two-dimensional array is displayed from the bottom right then up and left, or from the bottom left and up. In other words, the entries in the array must be spun 90° or 180° and then drawn in each block at the correct angle.

Below is a portion of sample source code in Microsoft C++ used to draw the text on top of the game cube 10 at step 44 with this in mind:

```
**********************************************************
    for (col=0;col<num_cols;col++)  {
      for (row+0;row<num rows;row++)  {
        text locx=(int) ((top_len* (num_rows-col))+conptxl-
29+(block_width*(row+1)));
        text_locy=(int) ((conptyl+8) - (top_len* (num_rows-
col)));
        if (facing_side == ft) letter[0]=top[col] [row];
        if (facing_side == rt) letter[0]=top[num_cols-1)-
row] [col];
        if (facing_side == tp) letter[0]=back[num_cols-1)-
col] [(num rows-1)-row];
        if (facing_side == bm) letter[0]=front[col] [row];
        if (facing_side == lt) letter[0]=top[row] [(num-rows-
1)-col];
        if (facing_side == bk) letter[0]=top[(num_cols-1)-
col] [num_rows-1)-row];
         if (facing_side == rt) pDC->TextOut (text_locx+17,
-(text_locy-6),letter,1);
         else if (facing_side == lt) pDC->TextOut (text_locx+4,
-(text_locy+2),letter,1);
         else if(facing_side == bk||facing side==tp) pDC-
>TextOut (text_locx+18,-(text_locy+3),letter,1);
         else pDC->TextOut(text_locx+4,-(text_locy-
7),letter,1);
**********************************************************
```

Whenever a letter is entered at step 32, it is placed in one of the six arrays (one for each side) that is used to hold the answers the user has given. These arrays can have varying sizes, but preferably have a separate array entry for each block on each side of the game cube 10. Thus, if the user was on the top right of the back side and entered a "K", the corresponding array entry would be assigned the value "K". However, since the array entry may affect other sides, as when a "wrap-around" effect is used, it must also be determined if this entry affects any of the other sides. If so, the value must be entered in the appropriate array position for the other side(s). Because of this characteristic, along some edges it may be necessary to use reversible words to assure the proper "wrap-around" effect. This feature creates additional challenge in the creation and solving of the puzzle.

To determine if an array entry affects other sides, a procedure is called to determine if the block in question lies at a corner of the cube or along an edge. For the above example, the letter "K" would be sent to a procedure called enter_corner_letters as follows:

```
**********************************************************
void enter_corner_letters(char ltr, int yy, int xx){
if (yy==0) {
    if (facing_side == ft) top[(num_cols-1)] [xx]=ltr;
    if (facing_side == rt) top[(num_cols-1)-xx] [num_cols-
1)]=ltr;
    if (facing_side == lt) top[xx] [0]=ltr;
    if (facing_side == bk) top[0] [(num_cols-1)-xx]=ltr;
    if (facing_side == bm) front[(num_cols-1)] [xx]=ltr;
    if (facing_side == tp) back[0] [(num_cols-1)-xx]=ltr;
}
if (yy==(num_cols-1))  {
    if (facing_side == ft) bottom[0] [xx]=ltr;
```

-continued

```
    if (facing_side == rt) bottom[xx] [(num_cols-1)]=ltr;
    if (facing_side == lt) bottom[(num_cols-1)-xx] [0]=ltr;
    if (facing_side == bk) bottom[(num_cols-1)][num_cols-1)-
xx]=ltr;
    if (facing_side == tp) front[0] [xx]=ltr;
    if (facing_side == bm) back[(num_cols-1)] [(num_cols-1)-
xx]=ltr;
}
if (xx==0)  {
    if (facing_side == ft) left[yy] [(num_cols-1)]=ltr;
    if (facing_side == rt) front[yy] [(num_cols-1)]=ltr;
    if (facing_side == lt) back[yy] [num_cols-1)]=ltr;
    if (facing_side == bk) right[yy] [(num_cols-1)]=ltr;
    if (facing_side == bm) left[(num_cols-1)] [(num_cols-1)-
yy]=ltr;
    if (facing_side == tp) left[0] [yy]=ltr;
}
if (xx==(num_cols-1)) {
    if (facing_side == ft) right[yy] [0]=ltr;
    if (facing_side == rt) back[yy] [0]=ltr;
    if (facing_side == lt) front[yy] [0]=ltr;
    if (facing_side == bk) left[yy] [0]=ltr;
    if (facing_side == tp) right[0] [(num_cols-1)-yy]=ltr;
    if (facing_side == bm) right[(num_cols-1)] [yy]=ltr;
    }
}
**********************************************************
```

Of course, routines may also be added which score the user based on the number of boxes filled in per side and the amount of time taken to complete the entire puzzle. Also partially completed puzzles may be saved for completion at a later time. In addition, help features for solving the puzzle may be provided. For example, free letters may be provided either randomly or in response to specific inquiries from the user.

Those skilled in the art will also appreciate that the foregoing has set forth the presently preferred embodiments of the invention but that numerous alternative embodiments are possible without departing from the novel teachings and advantages of the invention. For example, it is not necessary that the user watch the game cube 10 spin. The user may select the left mouse button if it is desired to watch the game cube 10 spin and the right mouse button if it is desired to have the game cube 10 go to the new side without showing the spin.

Figure 5:
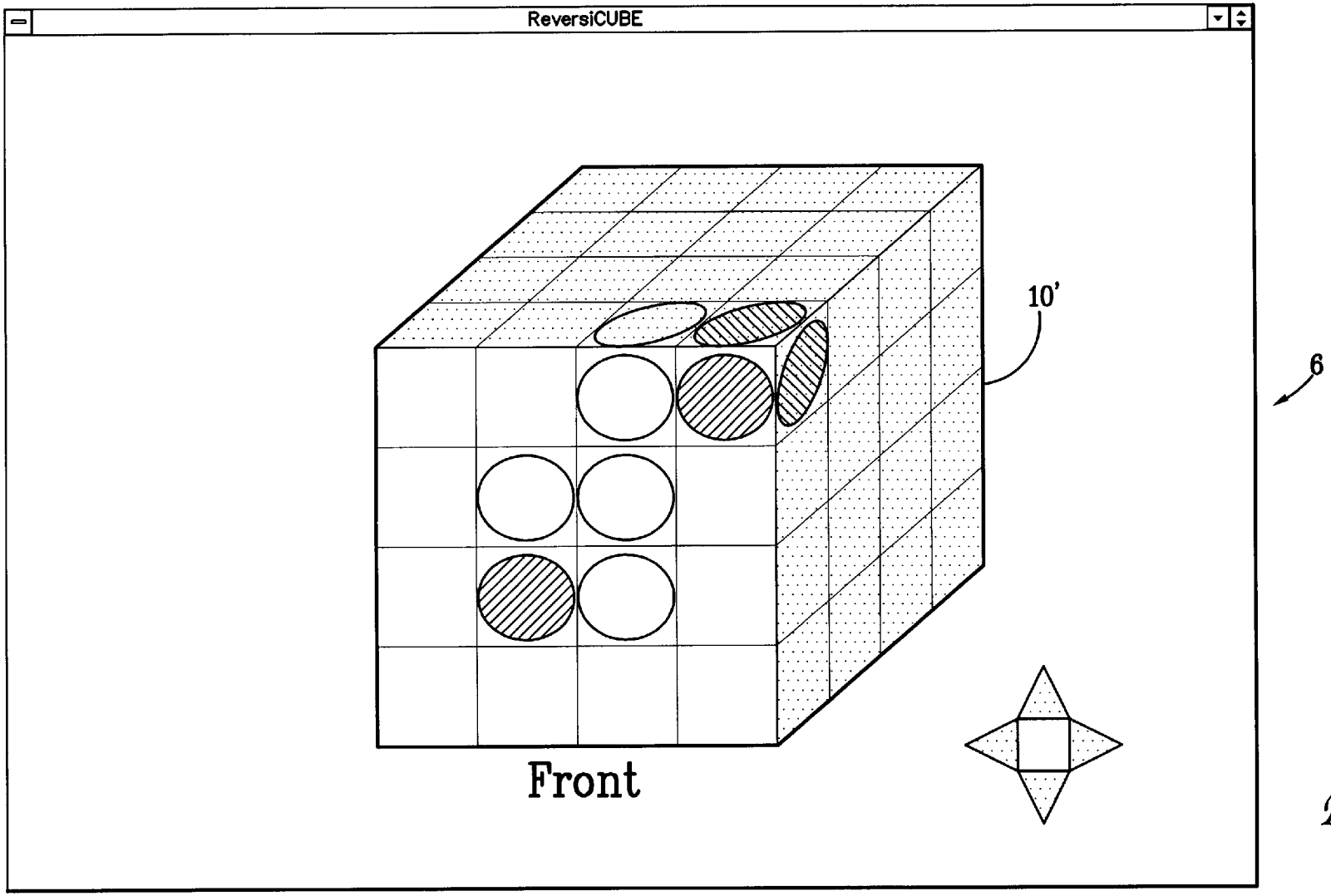
FIG. 5 illustrates a Reversi® game cube as displayed on a video display screen in accordance with the invention.
Figure 6:
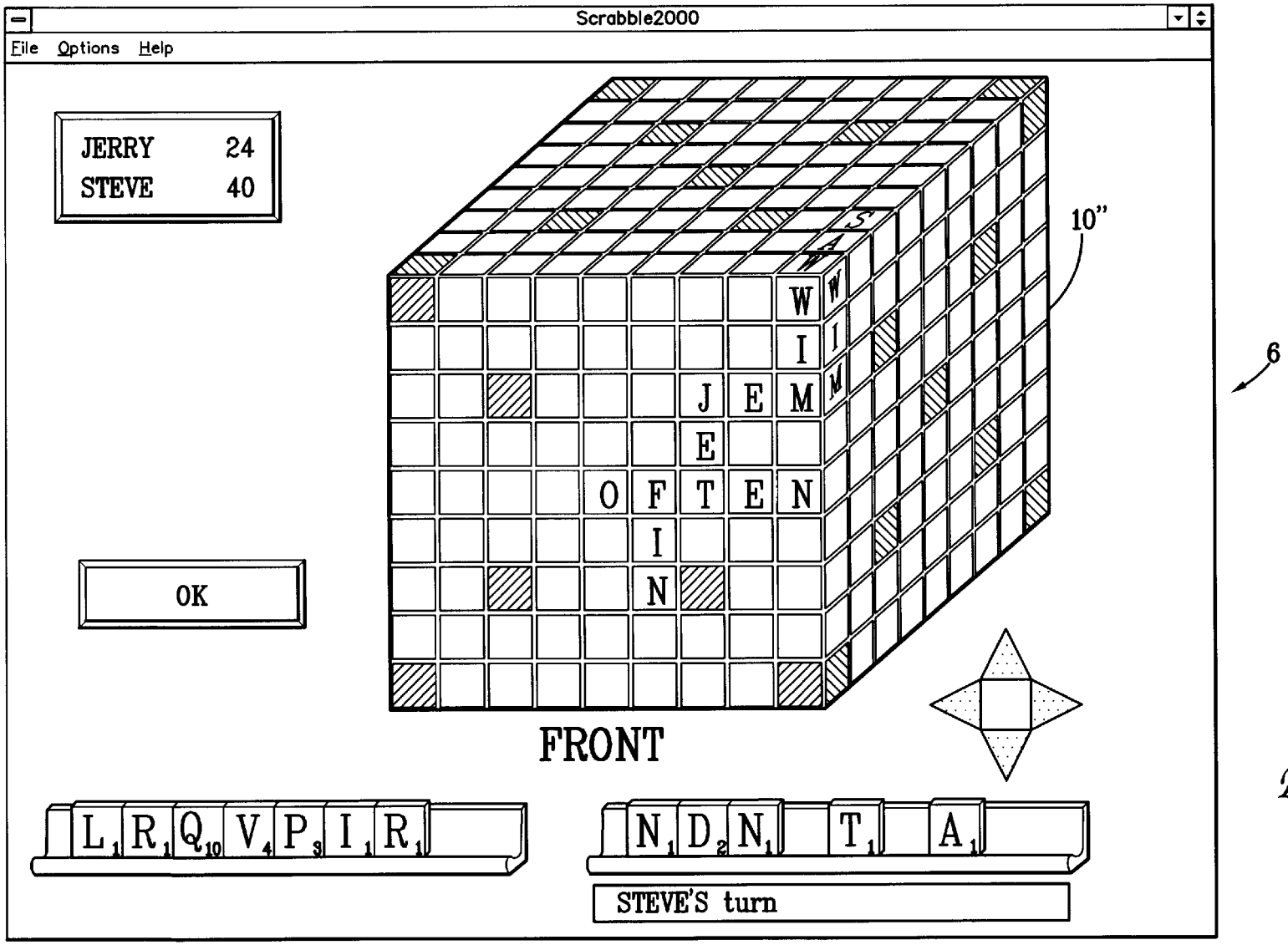
FIG. 6 illustrates a Scrabble™ game cube as displayed on a video display screen in accordance with the invention.

Moreover, other games may be implemented on the game cube 10 of the invention. As shown in FIG. 5, Reversi® may be played on game cube 10' by allowing play to wrap around the edges. Other games such as Othello® and Scrabble™ may be played using the techniques of the invention as well. For example, as shown in FIG. 6, three-dimensional Scrabble™ may be played by allowing the player to manipulate the Scrabble™ cube to the desired side and enter the letters as in conventional play of Scrabble™. As in the above crossword cube example, arrays are used to store the letters entered in each square on each side. Players have their used letters replenished randomly by the computer and play proceeds in a conventional manner except that the player has the option of selecting the spinner to spin the cube, of selecting a letter to drag and drop into a square of the cube, and of selecting "OK" to indicate that the word is complete. The computer then automatically determines if the word is valid, and, if so, tallies the player's score for display on the screen.

Accordingly, all such modifications and alternative games are intended to be included within the scope of the appended claims.

APPENDIX A

```
char front_ans[MAXQ][50],top_ans[MAXQ][50],right_ans[MAXQ][50];
char quesfd[MAXQ][50],datafd[MAXQ][50],ansfd[MAXQ][50],quesfa[MAXQ][50],
      ansfa[MAXQ][50],datafa[MAXQ][50],first_char;
char front[10][10],right[10][10],
      top[10][10],left[10][10],
      bottom[10][10],back[10][10];
// set points for the fixed position of the cube
      int conptx1=cube_x;
      int conpty1=cube_y;
      int conptx2=cube_x+CUBEWIDTH;
      int conpty2=cube_y;
      int conptx3=cube_x+CUBEWIDTH,conptx4=cube_x;
      int conpty3=cube_y+CUBEHEIGHT,conpty4=cube_y+CUBEHEIGHT;
      int conptx5=(int)(cube_x+cube_depth);
      int conpty5=(int)(cube_y-cube_depth);
      int conptx6=(int)(cube_x+cube_depth+CUBEWIDTH);
      int conpty6=(int)(cube_y-cube_depth);
      int conptx7=(int)(cube_x+cube_depth+CUBEWIDTH);
      int conpty7=(int)(cube_y+CUBEHEIGHT-cube_depth);
      int conptx8=(int)(cube_x+cube_depth);
      int conpty8=(int)(cube_y+CUBEHEIGHT-cube_depth);
// will be used as a buffer between which the points will move
float ptx[9],pty[9],remptx[9],rempty[9]; // used in division of pts
void CCubeView::spin_cube(void){
      float ctr;
      int limit;
      int top_vis=1,right_vis=1,left_vis=0,bottom_vis=0,back_vis=0,front_vis=1;
      POINT poly[4];
// "spin_cube" uses the 8 points of the cube to shade the appropriate
// area. The position of the points are 1,2,3,4 in the front, and 5,6,7,8
// are in the back. That is,        5-----6
//                                 1-|----2 |
//                                 | |     | |
//                                 | 8----|-7
//                                 4-----3
//

      ctr=-(num_spins/2);
      limit=(num_spins/2)-1;
// ctr=-8;
// while(ctr++<limit) {
      while(ctr++<0) {
            if(ctr==-3) SetCursor(AfxGetApp()->LoadCursor(IDC_CLOCKR));
            if(ctr==0) SetCursor(AfxGetApp()->LoadCursor(IDC_CLOCK));
            if(ctr==3) SetCursor(AfxGetApp()->LoadCursor(IDC_CLOCKL));
// figure out difference between desired points by getting the difference
// between the new and old point, then dividing that by n. Once the
// two are close enough, they are made the same (done below).
// for(double hh=0;hh<10000;hh++) hh=hh;
      if(inpt|=xsru) ptx[1]+=(remptx[1]+(x_stretcher*ctr));
      if(inpt|=xslu) ptx[2]+=(remptx[2]-(x_stretcher*ctr));
      ptx[3]+=(remptx[3]-(x_stretcher*ctr));
      if(inpt|=xsrd) ptx[4]+=(remptx[4]+(x_stretcher*ctr));
      if(inpt|=xsru) pty[1]+=(rempty[1]+(y_stretcher*ctr));
      if(inpt|=xslu) pty[2]+=(rempty[2]+(y_stretcher*ctr));
      pty[3]+=(rempty[3]-(y_stretcher*ctr));
      if(inpt|=xsrd)pty[4]+=(rempty[4]-(y_stretcher*ctr));
      ptx[5]+=(remptx[5]+(x_stretcher*ctr));
      if(inpt|=xsrd) ptx[6]+=(remptx[6]-(x_stretcher*ctr));
      if(inpt|=xsru) ptx[7]+=(remptx[7]-(x_stretcher*ctr));
      if(inpt|=xslu) ptx[8]+=(remptx[8]+(x_stretcher*ctr));
      pty[5]+=(rempty[5]+(y_stretcher*ctr));
      if(inpt|=xsrd) pty[6]+=(rempty[6]+(y_stretcher*ctr));
      if(inpt|=xsru) pty[7]+=(rempty[7]-(y_stretcher*ctr));
      if(inpt|=xslu) pty[8]+=(rempty[8]-(y stretcher*ctr)):
      top_vis=0,right_vis=0,left_vis=0,bottom_vis=0,back_vis=0,front_vis=0;
            switch(inpt) {
                  case xsd: if(ctr<4) {right_vis=1;front_vis=1;top_vis=1; }
                                                                  else
{right_vis=1;top_vis=1;back_vis=1; } break;
                  case xsu: if(ctr<-2) {right_vis=1;front_vis=1;top_vis=1; }
                                                                  else
{right_vis=1;front_vis=1;bottom_vis=1; } break;
                  case xsr: if(ctr<-3) {(right_vis=1;front_vis=1;top_vis=1; }
                                                                  else
{left_vis=1;front_vis=1;top_vis=1; } break;
                  case xsl: if(ctr<4) {right_vis=1;front_vis=1;top_vis=1; }
                                                                  else
```

APPENDIX A-continued

```
{back_vis=1;right_vis=1;top_vis=1; } break;
                    case xsru: if(ctr<-3) {right_vis=1;front_vis=1;top_vis=1; }
                                                                    else if(ctr<0)
{right_vis=1;front_vis=1;bottom_vis=1; }
                                                                    else
{left_vis=1;front_vis=1;bottom_vis=1; } break;
                    case xsrd: if(ctr<-2) {right_vis=1;front_vis=1;top_vis=1; }
                                                                    else if(ctr<3)
{left_vis=1;front_vis=1;top_vis=1; }
                                                                    else
{back_vis=1;left_vis=1;top_vis=1; } break;
//                  case xslu: if(ctr<1) {right_vis=1;front_vis=1;top_vis=1; }
//                                                                  else if(ctr<4)
{right_vis=1;front_vis=1;bottom_vis=1; }
//                                                                  else
{top_vis=1;right_vis=1;front_vis=1; } break;
        }
    if(top_vis&right_vis&front_vis) {
        erase[0].x=(int)ptx[1]; erase[0].y=-(int)pty[1];
        erase[1].x=(int)ptx[5]; erase[1].y=-(int)pty[5];
        erase[2].x=(int)ptx[6]; erase[2].y=-(int)pty[6];
        erase[3].x=(int)ptx[7]; erase[3].y=-(int)pty[7];
        erase[4].x=(int)ptx[3]; erase[4].y=-(int)pty[3];
        erase[5].x=(int)ptx[4]; erase[5].y=-(int)pty[4];
        erase[6].x=(int)ptx[1]; erase[6].y=-(int)pty[1];
        erase[7].x=(int)ptx[1]-15; erase[7].y=-(int)(pty[1]-11);
        erase[8].x=(int)ptx[4]-18; erase[8].y=-(int)(pty[4]+16);
        erase[9].x=(int)ptx[3]+7; erase[9].y=-(int)(pty[3]+18);
        erase[10].x=(int)ptx[7]+15; erase[10].y=-(int)(pty[7]+11);
        erase[11].x=(int)ptx[6]+18; erase[11].y=-(int)(pty[6]-14);
        erase[12].x=(int)ptx[5]-11; erase[12].y=-(int)(pty[5]-17);
        erase[13].x=(int)ptx[1]-15; erase[13].y=-(int)(pty[1]-11);
    }
    else if(top_vis&right_vis&back_vis&inpt|=xsl) { //down
        erase[0].x=(int)ptx[5]; erase[0].y=-(int)pty[5];
        erase[1].x=(int)ptx[8]; erase[1].y=-(int)pty[8];
        erase[2].x=(int)ptx[7]; erase[2].y=-(int)pty[7];
        erase[3].x=(int)ptx[3]; erase[3].y=-(int)pty[3];
        erase[4].x=(int)ptx[2]; erase[4].y=-(int)pty[2];
        erase[5].x=(int)ptx[1]; erase[5].y=-(int)pty[1];
        erase[6].x=(int)ptx[5]; erase[6].y=-(int)pty[5];
        erase[7].x=(int)ptx[5]-11; erase[7].y=-(int)pty[5];
        erase[8].x=(int)ptx[1]-11; erase[8].y=-(int)(pty[1]+11);
        erase[9].x=(int)ptx[2]+7; erase[9].y=-(int)(pty[2]+11);
        erase[10].x=(int)ptx[3]+11; erase[10].y=-(int)(pty[3]+11);
        erase[11].x=(int)ptx[7]+11; erase[11].y=-(int)(pty[7]-11);
        erase[12].x=(int)ptx[8]-11; erase[12].y=-(int)(pty[8]-11);
        erase[13].x=(int)ptx[5]-11; erase[13].y=-(int)(pty[5]-3);
    }
    p0C->   Polygon(erase,14);
// top of cube
    p0C->SelectObject (&backline);
    if(top_vis & ctr<7) {// don't draw it if it's in the back
        p0C->SelectObject (&topc);
        // top
            poly[0].x=(int)ptx[5]; poly[0].y=-(int)pty[5];
            poly[1].x=(int)ptx[6]; poly[1].y=-(int)pty[6];
            poly[2].x=(int)ptx[2]; poly[2].y=-(int)pty[2];
            poly[3].x=(int)ptx[1]; poly[3].y=-(int)pty[1];
            p0C->   Polygon(poly,4);
    }
// right part of cube
    if(right_vis&ctr<7) {
        p0C->SetectObject (&rightc);
        poly[0].x=(int)ptx[2]; poly[0].y=-(int)pty[2];
        poly[1].x=(int)ptx[6]; poly[1].y=-(int)pty[6];
        poly[2].x=(int)ptx[7]; poly[2].y=-(int)pty[7];
        poly[3].x=(int)ptx[3]; poly[3].y=-(int)pty[3];
        p0C->   Polygon(poly,4);
    }
// front of cube
    if(front_vis&ctr<7) {
        p0C->SelectObject (&frontc);
        poly[0].x=(int)ptx[1]; poly[0].y=-(int)pty[1];
        poly[1].x=(int)ptx[2]; poly[1].y=-(int)pty[2];
        poly[2].x=(int)ptx[3]; poly[2].y=-(int)pty[3];
        poly[3].x=(int)ptx[4]; poly[3].y=-(int)pty[4];
        p0C->   Polygon(poly,4);
```

APPENDIX A-continued

```
        }
// left part of cube
        if(left_vis&ctr<7) {// don't draw it if it's in the back
                p0C->SetectObject (&leftc);
                poly[0].x=(int)ptx[5]   ; poly[0].y=-(int)pty[5];
                poly[1].x=(int)ptx[1]; poly[1].y=-(int)pty[1];
                poly[2].x=(int)ptx[4]; poly[2].y=-(int)pty[4];
                poly[3].x=(int)ptx[8]; poly[3].y=-(int)pty[8];
                p0C->   Polygon(poly,4);
        }
// bottom of cube
        if(bottom vis&ctr<7) {
                p0C->SetectObject (&bottomc);
                poly[0].x=(int)ptx[4]   ; poly[0].y=-(int)pty[4];
                poly[1].x=(int)ptx[3]; poly[1].y=-(int)pty[3];
                poly[2].x=(int)ptx[7]; poly[2].y=-(int)pty[7];
                poly[3].x=(int)ptx[8]; poly[3].y=-(int)pty[8];
                p0C->   Polygon(poly,4);
        }
// back of cube
        if(back_vis&ctr<7) {
                p0C->SelectObject (&backc);
                poly[0].x=(int)ptx[5]   ; poly[0].y=-(int)pty[5];
                poly[1].x=(int)ptx[6]   ; poly[1].y=-(int)pty[6];
                poly[2].x=(int)ptx[7]; poly[2].y=-(int)pty[7];
                poly[3].x=(int)ptx[8]; poly[3].y=-(int)pty[8];
                p0C->   Polygon(poly,4);
        }
        } // end for loop statement
        p0C->SelectObject (pOrgBru);
        p0C->SelectObject (pOrgPen);
                SetCursor(AfxGetApp()->LoadCursor(IDC_CC_CURSOR));
                ReleaseDC(p0C);
void CCubeView::DrawCube(CDC * p0C)
{
        int n, text_locx,text_locy;
        int ypoly[8];
        int xpoly[8];
        float side_block_width=cube_depth/num_cols;
        POINT poly[4];
                tcbx=(int)(cube_x+cube_width+45);
                tcby=(int)(cube_height+cube_y+24);
        active_pager=ac_pager;
                block_height=cube_height/num_rows;
                block_width=cube_width/num_cols;
// reset numbers to where they were in the beginning
        ptx[1]=conptx1,pty[1]=conpty1,ptx[2]=conptx2,pty[2]=conpty2;
        ptx[3]=conptx3,pty[3]=conpty3,ptx[4]=conptx4,pty[4]=conpty4;
        ptx[5]=conptx5,pty[5]=conpty5,ptx[6]=conptx6,pty[6]=conpty6;
        ptx[7]=conptx7;pty[7]=conpty7;ptx[8]=conptx8;pty[8]=conpty8;
        // front
        poly[0].x=(int)ptx[1]; poly[0].y=(int)-pty[1];
        poly[1].x=(int)ptx[2]; poly[1].y=(int)-pty[2];
        poly[2].x=(int)ptx[3]; poly[2].y=(int)-pty[3];
        poly[3].x=(int)ptx[4]; poly[3].y=(int)-pty[4];
        //      lpttt=poly;
        CBrush MyBrush2;
        MyBrush2.CreateSolidBrush(front_color);
        p0C->SelectObject (&MyBrush2);
        p0C->Polygon(poly,4);
        CBrush MyBrush3;
        MyBrush3.CreateSolidBrush(top_color) ;
        p0C->SelectObject (&MyBrush3);
        //TOP
        poly[0].x=(int)ptx[5]; poly[0].y=(int)-pty[5];
        poly[1].x=(int)ptx[6]; poly[1].y=(int)-pty[6];
        poly[2].x=(int)ptx[2]; poly[2].y=(int)-pty[2];
        poly[3].x=(int)ptx[1]; poly[3].y=(int)-pty[1];
        p0C->   Polygon(poly,4);
         //RIGHT
        CBrush MyBrush4;
        MyBrush4.CreateSolidBrush(right_color) ;
        p0C->SelectObject (&MyBrush4);
        poly[0].x=(int)ptx[2]; poly[0].y=(int)-pty[2];
        poly[1].x=(int)ptx[6]; poly[1].y=(int)-pty[6];
        poly[2].x=(int)ptx[7]; poly[2].y=(int)-pty[7];
        poly[3].x=(int)ptx[3]; poly[3].y=(int)-pty[3];
        p0C->   Polygon(poly,4);
// draw lines that run up side and on top of cube
```

APPENDIX A-continued

```
        draw_text(0, p0C);
        draw_text_top(p0C);
        draw_text_right(p0C);
    p0C->SelectObject (&CubePen);    //reselect the pen
    for(n=1;n<num_cols;n++) {
        xpoly[0]=(int)(ptx[1]+(n*block_width));
        ypoly[0]=(int)-pty[1];
        xpoly[1]=(int)(ptx[1]+(n*block_width));
        ypoly[1]=(int)-pty[4];
        p0C->   MoveTo (xpoly[0],ypoly[0]);
        p0C->   LineTo ( xpoly[1],ypoly[1]);
    }
    for(n=1;n<num_rows;n++) {
        xpoly[0]=(int)ptx[1];
        ypoly[0]=(int)-(pty[1]+(n*block_height));
        xpoly[1]=(int)ptx[2];
        ypoly[1]=(int)-(pty[1]+(n*block_height));
        p0C->   MoveTo (xpoly[0],ypoly[0]);
        p0C->   LineTo (xpoly[1],ypoly[1]);
    }
    for(n=1;n<num_rows;n++) {
        xpoly[0]=(int)ptx[2];
        ypoly[0]=(int)-(pty[2]+(n*block_height));
        xpoly[1]=(int)ptx[6];
        ypoly[1]=(int)-(pty[6]+(n*block_height));
        p0C->   MoveTo (xpoly[0],ypoly[0]);
        p0C->   LineTo (xpoly[1],ypoly[1]);
    }
    for(n=1;n<num_rows;n++) {
        xpoly[0]=(int)(ptx[1]+(n*block_width));
        ypoly[0]=(int)-pty[1];
        xpoly[1]=(int)(ptx[5]+(n*block_width));
        ypoly[1]=(int)-pty[6];
        p0C->   MoveTo (xpoly[0],ypoly[0]);
        p0C->   LineTo (xpoly[1],ypoly[1]);
    }
    for(n=1;n<num_cols+1;n++) {
        xpoly[0]=(int)(ptx[2]+(n*side_block_width));
        ypoly[0]=(int)-(pty[2]-(n*side_block_width));
        xpoly[1]=(int)(ptx[2]+(n*side_block_width));
        xpoly[1]=(int)-(pty[4]-(n*side_block_width));
        p0C->   MoveTo (xpoly[0],ypoly[0]);
        p0C->   LineTo ( xpoly[1],ypoly[1]);
    }
    for(n=1;n<num_cols+1;n++) {
        xpoly[0]=(int)(ptx[1]+(n*side_block_width));
        ypoly[0]=(int)-(pty[1]-(n*side_block_width));
        xpoly[1]=(int)(ptx[2]+(n*side_block_width));
        ypoly[1]=(int)-(pty[1]-(n*side_block_width));
        p0C->   MoveTo (xpoly[0],ypoly[0]);
        p0C->   LineTo ( xpoly[1],ypoly[1]);
    }
}
void CCubeView::do_spin() {
        CDC * p0C;
        p0C = GetDC();
        switch(facing_side) {
            case ft:    process_character();
                                                    spin_cube();
                break;
            case rt:    if(inpt==xsd) {
                                                        inpt=xsr;
                                                        ResetPoints();
                                                    inpt=xsd;
                                                    process_character();
                                                    spin_cube();
                                                    }
                                                    else if(inpt==xsu) {
                                                        inpt=xsr;
                                                        ResetPoints();
                                                    inpt=xsu;
                                                    process_character();
                                                    spin_cube();
                                                    }
}
void process_character() {
        int NumTimes=15;
//      num_spins=16;
        if(facing_side==tp & inpt==xsr) inpt=xsru;
```

APPENDIX A-continued

```
        if(facing_side==bm & inpt==xsr) inpt=xsrd;
        if (inpt == xslu) {
        int NumTimes=19;
        num_spins=20;
        remptx[1]=(conptx6−ptx[1])/NumTimes;
        remptx[2]=0;
        remptx[3]=(conptx1−ptx[3])/NumTimes;
        remptx[4]=(conptx5−ptx[4])/NumTimes;
        rempty[1]=(conpty6−pty[1])/NumTimes;
        rempty[2]=0;
        rempty[3]=(conpty1−pty[3])/NumTimes;
        rempty[4]=(conpty5−pty[4])/NumTimes;
        remptx[5]=(conptx7−ptx[5])/NumTimes;
        remptx[6]=(conptx3−ptx[6])/NumTimes;
        remptx[7]=(conptx4−ptx[7])/NumTimes;
        remptx[8]=0;
        rempty[5]=(conpty7−pty[5])/NumTimes;
        rempty[6]=(conpty3−pty[6])/NumTimes;
        rempty[7]=(conpty4−pty[7])/NumTimes;
        rempty[8]=0;
        x_stretcher=1;
        y_stretcher=1;
        switch(facing_side) {
    case ft: facing_side=rt; break;
    case bm: facing_side=rt; break;
    case bk: facing_side=lt; break;
    case tp: facing_side=rt; break;
    case rt: facing_side=bk; break;
    case lt: facing_side=ft;
        }
        }
        if (inpt == xsru) {
        remptx[1]=0;
        remptx[2]=(conptx5−ptx[2])/NumTimes;
        remptx[3]=(conptx6−ptx[3])/NumTimes;
        remptx[4]=(conptx2−ptx[4])/NumTimes;
            rempty[1]=0;
        rempty[2]=(conpty5−pty[2])/NumTimes;
        rempty[3]=(conpty6−pty[3])/NumTimes;
        rempty[4]=(conpty2−pty[4])/NumTimes;
        remptx[5]=(conptx4−ptx[5])/NumTimes;
        remptx[6]=(conptx8−ptx[6])/NumTimes;
        remptx[7]=0;
        remptx[8]=(conptx3−ptx[8])/NumTimes;
        rempty[5]=(conpty4−pty[5])/NumTimes;
        rempty[6]=(conpty8−pty[6])/NumTimes;
        rempty[7]=0;
        rempty[8]=(conpty3−pty[8])/NumTimes;
        x_stretcher=.4;
        y_stretcher=.4;
        switch(facing_side) {
    case ft: facing_side=lt; break;
    case bm: facing_side=lt; break;
    case bk: facing_side=tmp_rt; break;
    case tp: facing_side=lt; break;
    case rt: facing_side=ft; break;
    case lt: facing_side=bk;
        }
        }
if (inpt == xsrd) {         //          w
    remptx[1]=(conptx3−ptx[1])/NumTimes;
    remptx[2]=(conptx7−ptx[2])/NumTimes;
    remptx[3]=(conptx8−ptx[3])/NumTimes;
    remptx[4]=0;
    rempty[1]=(conpty3−pty[1])/NumTimes;
    rempty[2]=(conpty7−pty[2])/NumTimes;
    rempty[3]=(conpty8−pty[3])/NumTimes;
    rempty[4]=0;
    remptx[5]=(conptx2−ptx[5])/NumTimes;
    remptx[6]=0;
    remptx[7]=(conptx5−ptx[7])/NumTimes;
    remptx[8]=(conptx1−ptx[8])/NumTimes;
    rempty[5]=(conpty2−pty[5])/NumTimes;
    rempty[6]=0;
    rempty[7]=(conpty5−pty[7])/NumTimes;
    rempty[8]=(conpty1−pty[8])/NumTimes;
        x_stretcher=.6;
    y_stretcher=.4;
    switch(facing_side) {
```

APPENDIX A-continued

```
        case ft: facing_side=lt; break;
        case bm: facing_side=lt; break;
        case bk: facing_side=rt; break;
        case tp: facing_side=lt; break;
        case rt: facing_side=ft; break;
        case lt: facing_side=bk;
      }
}
if (inpt == xsd) {
      remptx[1]=(conptx4-ptx[1])/NumTimes;
      remptx[2]=(conptx3-ptx[2])/NumTimes;
      remptx[3]=(conptx7-ptx[3])/NumTimes;
      remptx[4]=(conptx8-ptx[4])/NumTimes;
      rempty[1]=(conpty4-pty[1])/NumTimes;
      rempty[2]=(conpty3-pty[2])/NumTimes;
      rempty[3]=(conpty7-pty[3])/NumTimes;
      rempty[4]=(conpty8-pty[4])/NumTimes;
      remptx[5]=(conptx1-ptx[5])/NumTimes;
      remptx[6]=(conptx2-ptx[6])/NumTimes;
      remptx[7]=(conptx6-ptx[7])/NumTimes;
      remptx[8]=(conptx5-ptx[8])/NumTimes;
      rempty[5]=(conpty1-pty[5])/NumTimes;
      rempty[6]=(conpty2-pty[6])/NumTimes;
      rempty[7]=(conpty6-pty[7])/NumTimes;
      rempty[8]=(conpty5-pty[8])/NumTimes;
// x_stretcher and y_stretcher are used to help give the cube the spinning
// effect, giving them a rounder motion.
      x_stretcher=.001;
      y_stretcher=.32;
      switch(facing_side) {
        case ft: facing_side=tp; break;
        case bm: facing_side=ft; break;
        case bk: facing_side=tp; break;
        case tp: facing_side=bk; break;
        case rt: facing_side=tp; break;
        case lt: facing_side=tp; break;
      }
}
      switch(facing_side) {
        case tp: front_color=tp_col; top_color=bk_col; right_color=rt_col;
                bottom_color=ft_col; left_color=lt_col; back_color=bm_col; break;
        case ft: front_color=ft_col; top_color=tp_col; right_color=rt_col;
                bottom_color=bm_col; left_color=lt_col; back_color=bk_col; break;
        case bk: front_color=bk_col; top_color=tp_col; right_color=lt_col;
                bottom_color=bm_col; left_color=rt_col; back_color=ft_col; break;
        case rt: front_color=rt_col; top_color=tp_col; right_color=bk_col;
                bottom_color=bm_col; left_color=ft_col; back_color=lt_col; break;
        case bm: front_color=bm_col; top_color=ft_col; right_color=rt_col;
                bottom_color=bk_col; left_color=lt_col; back_color=tp_col; break;
        case lt: front_color=lt_col; top_color=tp_col; right_color=ft_col;
                bottom_color=bm_col; left_color=bk_col; back_color=rt_col; break;
                // tmp_lt put in for when cube is temporarily on the left side for spinning and
                is
sideways
        case tmp_lt: front_color=bk_col; top_color=tp_col; right_color=lt_col;
facing_side=bk;
                bottom_color=bm_col; left_color=rt_col; back_color=ft_col; break;
        case tmp_rt: front_color=rt_col; top_color=bk_col; right_color=bm_col;
                bottom_color=ft_col; left_color=tp_col; back_color=lt_col; break;
}
```

We claim:

1. A programmable computer programmed to display a crossword game on a cube which, during play of said crossword game, is manipulated using a pointer device in three dimensions on a display associated with said programmable computer, comprising:

a display generator which generates on said display a display image of said cube and an image of said crossword game superimposed on said cube such that first and second faces of said cube are divided into a plurality of squares and a number of said plurality of squares are adapted to receive a letter during completion of a three-dimensional crossword puzzle during play of said crossword game, said first face of said cube sharing a common edge with said second face of said cube;

an icon, separate from said cube, with arrows indicating respective directions of rotation, whereby user selection of said arrows with said pointer device causes said cube to rotate to respective faces of said cube during play of said crossword game; and data arrays which store data created during play of said crossword game in such a manner that certain data on said first face of said cube is related to certain data on said second face of said cube, whereby play of said crossword game is continuous around said common edge separating said first and second faces of said cube.

2. A programmable computer as in claim 1, wherein said pointer device comprises a user-operated mouse, and wherein said display generator further generates a keyboard on said display for selection of letters for said squares using said mouse.

3. A programmable computer as in claim 1, wherein said data arrays comprise a two-dimensional crossword array for each face of said cube and each entry in each array corresponds to one of said plurality of squares.

4. A programmable computer as in claim 3, wherein said data arrays further comprise a data array for each face of said cube, each data array containing numbered clues for said crossword game and locations for answers to said numbered clues in predetermined squares of said cube.

5. A programmable computer as in claim 3, wherein letters in said two-dimensional crossword array for each face of said cube are rotated one of 0, 90, and 180 degrees after rotation of said cube so that said letters are displayed in a proper orientation to said user.

6. A programmable computer as in claim 3, wherein certain squares in said first and second faces sharing said common edge are populated with the same letters whereby letters entered into array entries corresponding to said certain squares in a crossword array for said first face are copied into array entries corresponding to said certain squares in a crossword array for said second face.

7. A programmable computer as in claim 1, wherein said display generator displays three sides of said cube on said display at a time.

8. A programmable computer programmed to display a game on a cube which, during play of said game, is manipulated in three dimensions on a display associated with said programmable computer, comprising:

a display generator which generates on said display a display image of said cube and an image of said game superimposed on said cube;

means for rotating said cube to respective faces during play of said game;

data arrays which store data created during play of said game in such a manner that certain data on a first face of said cube is related to certain data on a second face of said cube which shares a common edge with said first face, whereby play of said game is continuous around said common edge separating said first and second faces of said cube; and means for simulating stretching of said cube during rotation of said cube so that said cube appears to said user to rotate as a sphere.

9. A programmable computer programmed to display a game on a cube which, during play of said game, is manipulated using a pointer device in three dimensions on a display associated with said programmable computer, comprising:

a display generator which generates on said display a display image of said cube and an image of said game superimposed on said cube;

an icon, separate from said cube, with arrows indicating respective directions of rotation, whereby user selection of said arrows with said pointer device causes said cube to rotate to respective faces during play of said game, said icon further including a center portion indicating the color of the face of the cube currently facing the user; and data arrays which store data created during play of said game in such a manner that certain data on a first face of said cube is related to certain data on a second face of said cube which shares a common edge with said first face, whereby play of said game is continuous around said common edge separating said first and second faces of said cube.

10. A computer readable memory for use by a computer to control play of a crossword game on a cube which, during play of said crossword game, is manipulated in three dimensions on a display associated with said computer, said memory comprising:

means for generating on said display a display image of said cube and an image of said crossword game superimposed on said cube such that first and second faces of said cube are divided into a plurality of squares and a number of said plurality of squares are adapted to receive a letter during completion of a three-dimensional crossword puzzle during play of said crossword game, said first face of said cube sharing a common edge with said second face of said cube;

icon generating means for generating on said display an icon, separate from said cube, with arrows indicating respective directions of rotation, whereby user selection of said arrows with said pointer device causes said cube to rotate to respective faces of said cube during play of said crossword game; and storing means for storing data created during play of said crossword game in such a manner that certain data on said first face of said cube is related to certain data on said second face of said cube, whereby play of said crossword game is continuous around said common edge separating said first and second faces of said cube.

11. A computer readable memory as in claim 10, wherein said generating means generates a keyboard on said display for selection of letters for said squares using a user-operated mouse.

12. A computer readable memory as in claim 10, wherein said storing means comprises a two-dimensional crossword array for each face of said cube and each entry in each array corresponds to one of said plurality of squares.

13. A computer readable memory as in claim 12, wherein said storing means further comprises a data array for each face of said cube, each data array containing numbered clues for said crossword game and locations for answers to said numbered clues in predetermined squares of said cube.

14. A computer readable memory as in claim 12, wherein letters in said two-dimensional crossword array for each face of said cube are rotated one of 0, 90, and 180 degrees after rotation of said cube so that said letters are displayed in the proper orientation to said user.

15. A computer readable memory as in claim 12, wherein certain squares in said first and second faces sharing said common edge are populated with the same letters whereby letters entered into array entries corresponding to said certain squares in a crossword array for said first face are copied into array entries corresponding to said certain squares in a crossword array for said second face.

16. A computer readable memory as in claim 10, wherein said generating means displays three sides of said cube on said display at a time.

17. A computer readable memory for use by a computer to control play of a game on a cube which, during play of said game, is manipulated in three dimensions on a display associated with said computer, said memory comprising:

means for generating on said display a display image of said cube and an image of said game superimposed on said cube;

means for rotating said cube to respective faces during play of said game;

storing means for storing data created during play of said game in such a manner that certain data on a first face of said cube is related to certain data on a second face of said cube which shares a common edge with said first face, whereby play of said game is continuous around said common edge separating said first and second faces of said cube; and means for simulating stretching of said cube during rotation of said cube so that said cube appears to said user to rotate as a sphere.

18. A computer readable memory for use by a computer to control play of a game on a cube which, during play of said game, is manipulated in three dimensions on a display associated with said computer, said memory comprising:

means for generating on said display a display image of said cube and an image of said game superimposed on said cube;

icon generating means for generating on said display an icon, separate from said cube, with arrows indicating respective directions of rotation, whereby user selection of said arrows with said pointer device causes said cube to rotate to respective faces during play of said game, said icon further including a center portion indicating the color of the face of the cube currently facing the user; and storing means for storing data created during play of said game in such a manner that certain data on a first face of said cube is related to certain data on a second face of said cube which shares a common edge with said first face, whereby play of said game is continuous around said common edge separating said first and second faces of said cube.

19. A method of playing a crossword game on a cube displayed on a video display, comprising the steps of:

generating on said video display a display image of said cube and an image of said crossword game superimposed on said cube such that first and second faces of said cube are divided into a plurality of squares and a number of said plurality of squares are adapted to receive a letter during completion of a three-dimensional crossword puzzle during play of said crossword game and such that said first face of said cube share a common edge with said second face of said cube;

selectively rotating said cube to respective faces of said cube during play of said crossword game by selecting one of a plurality of arrows of an icon which is separate from said cube, said icon indicating respective directions of rotation of said cube;

selectively entering game data into two-dimensional arrays corresponding to each face of said cube during play of said crossword game; and storing said game data in such a manner that certain data on said first face of said cube is related to certain data on said second face of said cube, whereby play of said crossword game is continuous around said common edge separating said first and second faces of said cube.

20. A method as in claim 19, wherein said generating step comprises the step of generating a keyboard on said video display for selection of letters for said squares.

21. A method as in claim 19, comprising the further step of storing a data array for each face of said cube, each data array containing numbered clues for said crossword game and locations for answers to said numbered clues in predetermined squares of said cube.

22. A method as in claim 19, wherein said selectively rotating step comprises the step of rotating letters in a two-dimensional array for each face of said cube by one of 0, 90, and 180 degrees after rotation of said cube so that said letters are displayed in the proper orientation to said user.

23. A method as in claim 19, wherein said selectively entering step comprises the step of populating certain squares in said first and second faces sharing said common edge with the same letters whereby letters entered into array entries corresponding to said certain squares in a two-dimensional array for said first face are copied into array entries corresponding to said certain squares in a two-dimensional array for said second face.

24. A method as in claim 19, wherein said generating step comprises the step of displaying three sides of said cube on said video display at a time.

25. A method of playing a game on a cube displayed on a video display, comprising the steps of:

generating on said video display a display image of said cube and an image of said game superimposed on said cube;

selectively rotating said cube to respective faces during play of said game;

selectively entering game data into two-dimensional arrays corresponding to each face of said cube during play of said game;

storing said game data in such a manner that certain data on a first face of said cube is related to certain data on a second face of said cube which shares a common edge with said first face, whereby play of said game is continuous around said common edge separating said first and second faces of said cube; and simulating stretching of said cube during rotation of said cube so that said cube appears to said user to rotate as a sphere.

26. A program storage device readable by a processor and storing thereon a program of instructions executable by said processor to perform the method steps of any one of claims 19, 20, 21, 22, 23, 24, or 25.

* * * * *

UNITED STATES PATENT AND TRADEMARK OFFICE

CERTIFICATE OF CORRECTION

PATENT NO. : 6,062,978

DATED : 5/16/00

INVENTOR(S) : Peter D. Martino et al.

It is certified that error appears in the above-identified patent and that said Letters Patent is hereby corrected as shown below:

Col. 24, line 47, after "cube" insert --by said rotating means--.

Signed and Sealed this

Third Day of April, 2001

*Attest:*

Nicholas P. Godici

NICHOLAS P. GODICI

*Attesting Officer*

*Acting Director of the United States Patent and Trademark Office*